United States Patent [19]

Pittman

[11] 4,370,994

[45] Feb. 1, 1983

[54] INFLATABLE UMBRELLA AND METHOD OF FABRICATING THE SAME

[76] Inventor: Benny R. Pittman, P.O. Box 672, Rutherfordton, N.C. 28139

[21] Appl. No.: 235,955

[22] Filed: Feb. 19, 1981

[51] Int. Cl.[3] ..... A45B 19/02

[52] U.S. Cl. ..... 135/20 B

[58] Field of Search ..... 135/20 R, 20 B

[56] References Cited

U.S. PATENT DOCUMENTS

| | | | |
|---|---|---|---|
| 1,411,560 | 4/1922 | Beaty . | |
| 2,401,252 | 5/1946 | Klimashesky | 135/20 B |
| 2,625,946 | 1/1953 | Kaston | 135/20 B |
| 2,679,256 | 5/1954 | Bocchino et al. . | |
| 2,810,391 | 10/1957 | Jones, Jr. . | |
| 3,053,266 | 9/1962 | Burns | 135/20 B X |
| 3,361,145 | 1/1968 | Jones . | |
| 3,538,928 | 11/1970 | Price | 135/20 B |
| 3,863,661 | 2/1975 | Aburto . | |
| 3,889,700 | 6/1975 | Kirley . | |
| 3,951,160 | 4/1976 | Nitu . | |
| 3,954,117 | 5/1976 | Wallace . | |
| 4,068,675 | 1/1978 | Pappanikolaou . | |

FOREIGN PATENT DOCUMENTS

| | | | |
|---|---|---|---|
| 1062809 | 9/1953 | France | 135/20 B |
| 1200717 | 7/1959 | France | 135/20 B |
| 1442639 | 5/1966 | France | 135/20 B |
| 444394 | 9/1967 | Switzerland . | |
| 1250616 | 10/1971 | United Kingdom . | |

*Primary Examiner*—Harland S. Skogquist

*Attorney, Agent, or Firm*—Bell, Seltzer, Park & Gibson

[57] ABSTRACT

An inflatable umbrella is provided which may be collapsed and retained in the form of a small easily carried package when not in use, and which may be rapidly inflated to an operative configuration by the breath of the user or other air source. The umbrella comprises a flexible plastic cover sheet having a generally circular outline, and an undercarriage which includes a flexible plastic panel having a star-like configuration, an elongate flexible plastic tubular member having a bulbous handle portion at the free end, and valve means mounted on the handle to permit air to be selectively blown into and released from the interior of the tubular member and enclosed airspace. The umbrella preferably also includes a flexible plastic bag mounted at the free end of the tubular member for retaining the umbrella in its collapsed position, and a drawstring may be disposed about the periphery of the cover sheet to permit the cover sheet to be drawn into a generally hemispheric configuration when in use. Two embodiments of a method of fabricating the above described umbrella are also disclosed.

11 Claims, 11 Drawing Figures

INFLATABLE UMBRELLA AND METHOD OF FABRICATING THE SAME

The present invention relates to an inflatable plastic umbrella, and to the method of fabricating the same.

Conventional umbrellas comprise a fabric cover, and a collapsible undercarriage which includes a rigid handle and a plurality of radiating metal spokes which support the fabric cover in its open expanded configuration. Such umbrellas are relatively expensive, they are easily broken, prone to malfunction, and the metal spokes present a safety hazard, particularly to the eyes, when the umbrella is opened in crowded conditions, as when the user is seated in an outdoor stadium. Further, the metal undercarriage of such umbrellas presents a dangerous lightning rod effect in an electrical storm.

It is accordingly an object of the present invention to provide an inflatable umbrella which eliminates the above problems associated with conventional umbrellas.

It is a more particular object of the present invention to provide an inflatable, all plastic umbrella which is inexpensive, which may be carried in a conveniently sized package when not in use, and which is easily expanded to its operative configuration by the breath of the user, or other air source, when the umbrella is needed.

It is still another object of the present invention to provide a method of fabricating an inflatable plastic umbrella of the described type.

These and other objects and advantages of the present invention are achieved in the embodiments illustrated herein by the provision of an inflatable umbrella which comprises a flexible plastic cover sheet having a generally circular outline, a flexible plastic panel which overlies the under surface of the cover sheet and is sealably joined along its peripheral edge to the cover sheet to define an enclosed airspace therebetween. An elongate flexible plastic tubular member or handle has one end sealably joined to the panel and so that the interior of the tubular member is in fluid communication with the enclosed airspace. Valve means is mounted so as to permit air to be selectively blown into and released from the interior of the tubular member and enclosed airspace. Such valve means may include a one way interior valve mounted between the tubular member and enclosed airspace to minimize the pressure necessary to inflate the umbrella. Preferably, the umbrella also includes a flexible plastic bag mounted at the free end of the tubular member, with the bag being sized to receive and retain the cover sheet, panel, and tubular member therein, when these components are collapsed.

As will be apparent, the umbrella may be inflated to an operative configuration by blowing air through the valve means and into the tubular member and enclosed airspace, and such that the resulting air pressure serves to rigidify the tubular member and support the cover sheet and panel in a generally open expanded configuration. The umbrella may be collapsed by releasing the air through the valve means to permit the cover sheet, panel, and tubular member to be folded into the bag. The umbrella preferably also includes a drawstring operatively disposed about the circular periphery of the cover sheet, to permit the cover sheet to be drawn into a generally hemispheric configuration and the circumference thereof to be selectively varied.

Also in accordance with the present invention, the umbrella may be fabricated by a method which includes the steps of forming a first sheet of flexible plastic material to have a generally circular periphery outline, forming a second sheet of flexible plastic material into a generally star-like peripheral outline, and with the second sheet having an opening formed centrally therein. An elongate flexible plastic tubular member is affixed to the second sheet to communicate with the opening, and valve means for selectively admitting and releasing air is mounted on the tubular member. The second sheet is positioned over the first sheet, and the periphery of the second sheet is then joined to the first sheet, as by heat sealing, to form an enclosed airspace therebetween. A flexible plastic bag may also be provided for receiving the collapsed umbrella, with the bottom of the bag being joined to the free end of the tubular member.

In a second embodiment, the umbrella may be fabricated by a method wherein the undercarriage is formed from two components which are a mirror image of each other, and with each component including a panel segment having a peripheral outline in the form of one half of a star, and a flexible plastic handle segment composed of a longitudinal half of a tubular member. These two undercarriage components are positioned in an abutting, face to face, opposed relationship, and then sealably joined together along the abutting edges such that the two panel segments collectively form a second sheet having a star-like outline, and the handle segments collectively define an elongate tubular member having a closed lower free end, and with a flexible bag joined to the lower free end. The undercarriage is then positioned over the cover sheet, and the periphery of the second sheet is then joined to the first sheet to form an enclosed airspace therebetween, and which communicates with the interior of the tubular member.

Some of the objects and advantages of the invention having been stated, others will appear as the description proceeds, when taken in connection with the accompanying drawings, in which FIG. 1 is a perspective view of an inflatable umbrella embodying the present invention;

Figure 1:
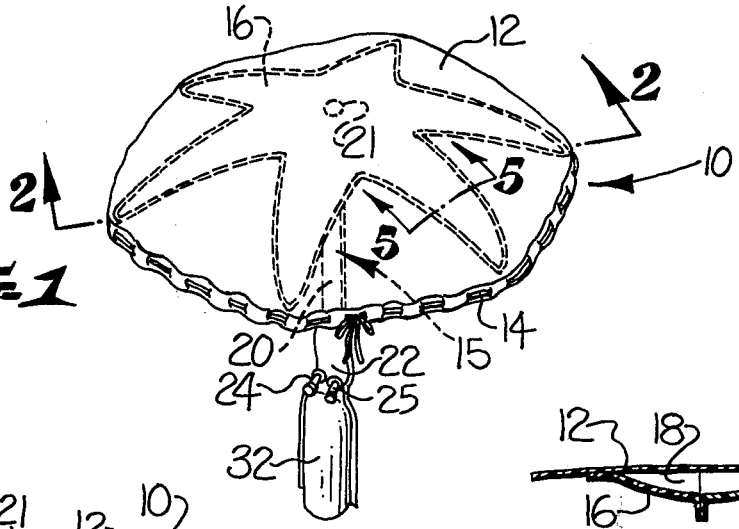
Figure 5:
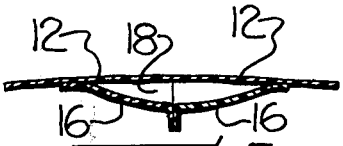
FIG. 5 is a fragmentary sectional elevation view taken substantially along the line 5—5 of FIG. 1.

Referring more specifically to the drawings, FIG. 1 illustrates a collapsible umbrella 10 embodying the present invention, and which includes a flexible plastic cover sheet 12 having a generally circular outline. The periphery of the sheet 12 includes a plurality of circumferentially spaced slots or eyelets, and a drawstring 14 is threaded through the slots or eyelets for the purposes described below.

The undercarriage 15 of the umbrella shown in FIG. 1 includes a flexible plastic panel 16 which overlies the under surface of the cover sheet 12. The panel 16 has a generally star-like peripheral outline, and the peripheral edge thereof is sealably joined, as by heat sealing, to the surface of the cover sheet to define an enclosed airspace 18 therebetween. As will be apparent, the star-like outline of the panel defines radiating spokes of the airspace which extend to a point closely adjacent the periphery of the cover sheet.

An elongate flexible plastic tubular member 20 forms the handle of the undercarriage, and has one end sealably joined to the panel 16, and an opening 21 is formed in the panel at the point of interconnection, so that the interior of the tubular member 20 is in fluid communication with the enclosed airspace 18.

Figure 10:
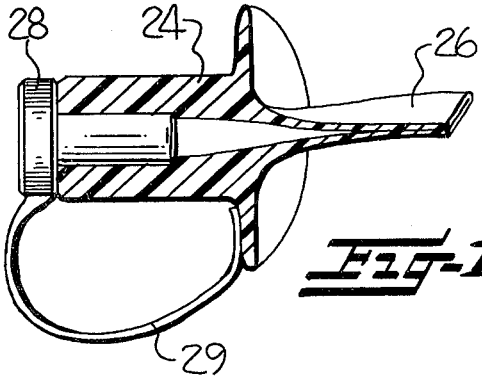
FIG. 10 is an enlarged fragmentary sectional view of a one-way valve as employed with the present invention.
Figure 11:
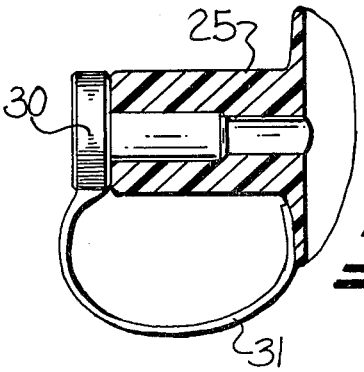
FIG. 11 is an enlarged fragmentary sectional view of a manually closable view adapted to permit the rapid release of air from the interior of the umbrella.

The opposite or free end of the tubular member 20 is shaped to include an enlarged bulbous portion 22, which is sized to permit ready engagement by the hand of the user. In addition, such other end is sealably closed, and valve means in the form of two separate valves 24, 25 is mounted on the bulbous portion for permitting air to be selectively blown into and released from the interior of the tubular member and thus the enclosed airspace. The inlet valve 24 is illustrated in detail in FIG. 10, and is designed to permit air only to enter the tubular member, with the flapper portion 26 precluding passage of air in the opposite direction. The valve 24 also includes a plug 28 for providing an additional seal, with the plug being retained by a tether 29. The outlet valve 25 is shown in FIG. 11, and includes a manually closable plug 30 carried on the tether 31, which when removed is adapted to permit passage of air in either direction. Thus upon removal of the plug of the valve, the umbrella may be rapidly deflated and collapsed.

Figure 2:
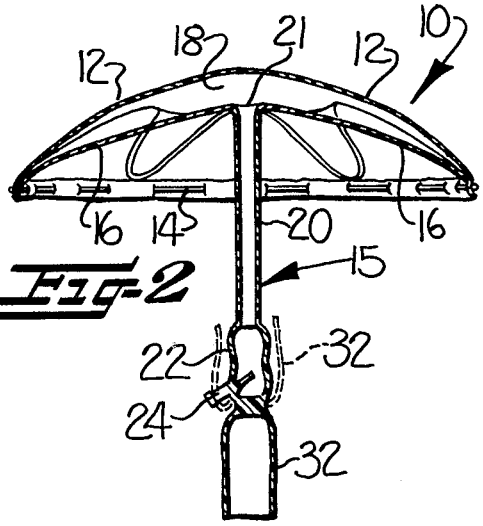
FIG. 2 is a sectional elevation view taken substantially along the line 2—2 of FIG. 1.

The umbrella 10 further comprises a flexible plastic bag 32 mounted at the free end of the tubular member 20, with the bag 32 being sized to receive and retain the cover sheet, panel, and tubular member when these components are collapsed. As best seen in FIG. 2, the free end of the tubular member is joined to the bottom portion of the flexible bag, as by heat sealing, and such that the bag may extend axially over a portion of the free end of the tubular member as shown in dashed lines, or the bag may be everted as shown in solid lines to open in a direction facing opposite the tubular member.

Figure 6:
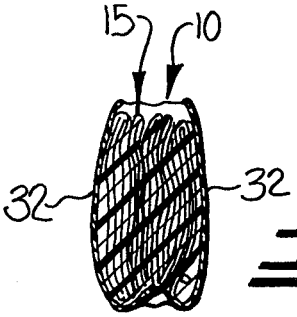
FIG. 6 is a sectional elevation view of the umbrella of FIG. 1 in its collapsed and packaged configuration.

In use, the umbrella 10 may be inflated to its operative configuration by blowing air through the valve 24 and into the tubular member 20 and enclosed airspace 18. This may ordinarily be accomplished by the breath of the user, or by employing a suitable pump or air cartridge. The resulting air pressure serves to rigidify the tubular member and support the cover sheet 12 and panel 16 in a generally open expanded configuration. The circumference of the cover sheet may be controlled by the drawstring 14, which also permits the cover sheet to be drawn into a somewhat hemispheric configuration as shown in FIGS. 1 and 2. During periods of non-use, the umbrella may be collapsed by releasing the air through the valve 25 to permit the cover sheet, panel, and tubular member to be folded into the bag 32 in the manner shown in FIG. 6. The resulting package may be conveniently carried, for example, in the pocket of the user.

Figure 3:
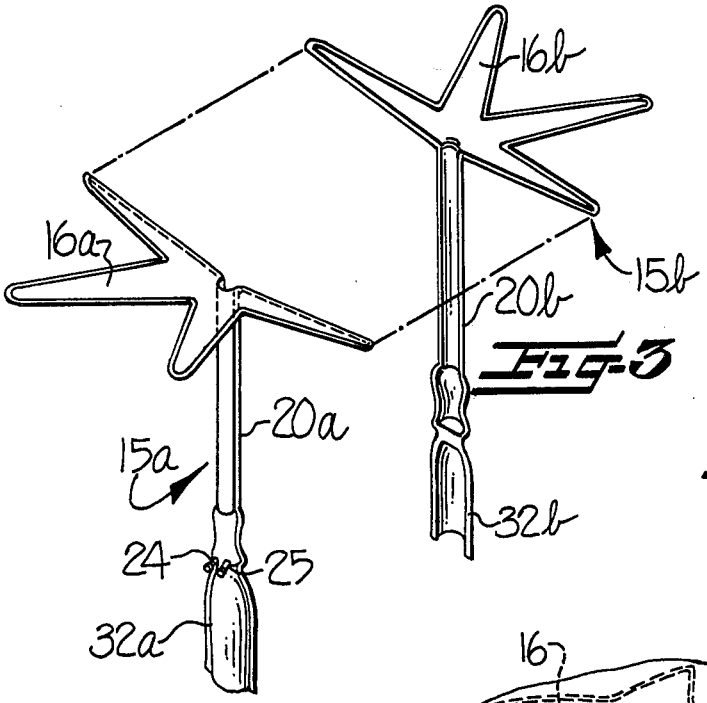
FIG. 3 is an exploded perspective view illustrating a step in the fabrication of the undercarriage of the umbrella shown in FIG. 1.
Figure 4:
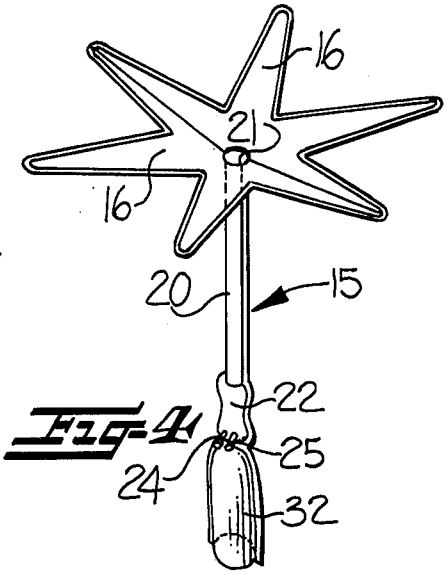
FIG. 4 is a perspective view illustrating a subsequent step in the method, and wherein the undercarriage components are joined together.

The umbrella 10 illustrated in FIG. 1 may be fabricated by forming a first sheet of flexible plastic material having a generally circular peripheral outline to form the cover sheet 12, and providing a plurality of eyelets about the periphery thereof for receiving the drawstring 14. As best seen in FIGS. 3 and 4, the undercarriage 15 of the umbrella may be formed from first and second undercarriage components **15*a*, 15*b* which are a mirror image of each other, and with each component including a panel segment 16*a*, 16*b* composed of a flexible plastic sheet material having a peripheral outline in the form of one half of a star, and a flexible plastic handle segment 20*a*, 20*b*, composed of a longitudinal half of a tubular member as well as a longitudinal half of a bag 32*a*, 32*b*. The air valves 24, 25 may be mounted in at least one of the handle segments, and the two undercarriage components are then positioned in an abutting face to face opposed alignment as seen in FIG. 4. The abutting edges of the two components 15*a*, 15*b* are then sealably joined, as by heat sealing, such that the panel segments 16*a*, 16*b* collectively form the second sheet 16 having a star-like outline, and the handle segments 20*a*, 20*b* collectively define the elongate tubular member 20, the bulbous portion 22, and the bag 32. Also, an opening 21 will be formed in the second sheet 16 which communicates with the interior of the tubular member. The undercarriage 15 is then joined to the first or cover sheet 12, by positioning the second sheet 16 centrally over the under surface of the first sheet 12 and then joining the periphery of the second sheet to the first sheet by heat sealing or the like, to form the enclosed airspace 18 therebetween which communicates through the opening 21** with the interior of the tubular member.

Figure 8:
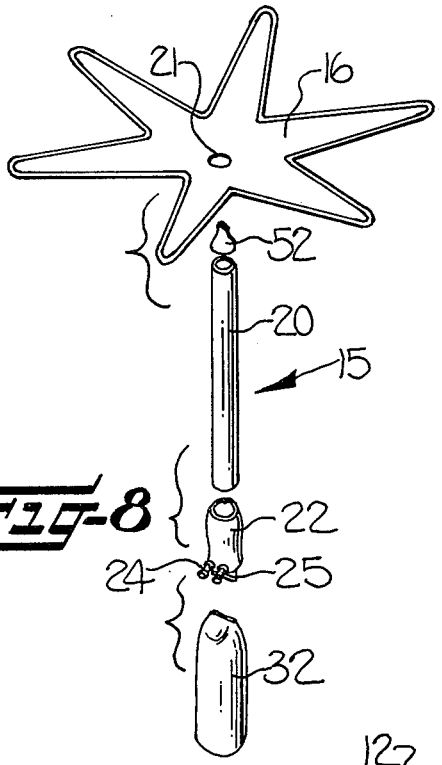
FIG. 8 is an exploded perspective view illustrating a step in the method of fabricating the umbrella shown in FIG. 7.
Figure 7:
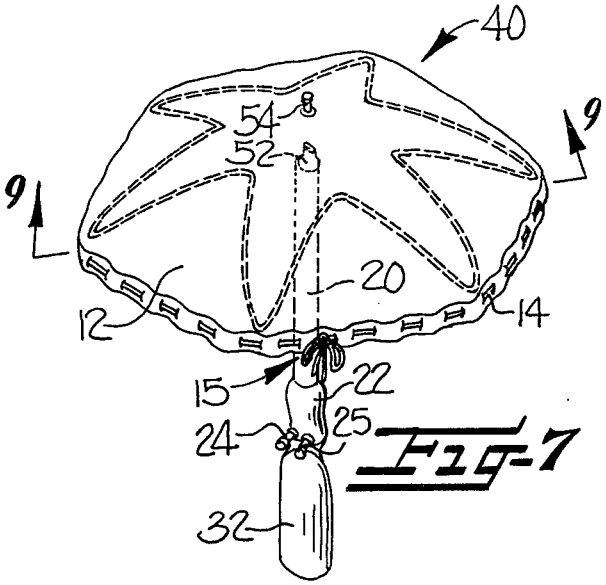
FIG. 7 is a perspective view of a second embodiment of a collapsible umbrella in accordance with the present invention.
Figure 9:
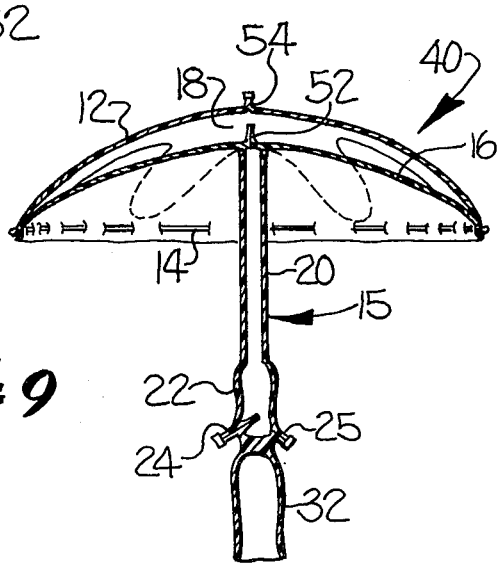
FIG. 9 is a sectional elevation view taken substantially along the line 9—9 of FIG. 7.

FIGS. 7–9 illustrate at 40 a second embodiment of an umbrella in accordance with the present invention, with the common numerals indicating components which are common to those of the above described umbrella 10. As best seen in FIG. 9, the valve means of the umbrella 40 includes not only the valves 24 and 25 in the undercarriage as described above, but further includes a one way interior valve 52 mounted to close the opening 21 in the panel 16. The valve 52 is generally similar to the valve 24 but without a plug, and serves to permit air to move from the tubular member into the enclosed airspace 18 while precluding movement in the opposite direction. The valve means further includes an exhaust valve 54, which is similar to the valve 25, and which is mounted on the cover sheet so as to directly communicate with the enclosed airspace 18. The above valve means permits air to be forced into the airspace 18 by squeezing the handle, thereby reducing the pressure in the tubular member and thus serving to minimize the resistance to air entering through the inlet valve 24. In other words, the pressure in the airspace 18 may be maximized by this procedure, while requiring only a moderate pressure from the breath of the user or other air source. As will be apparent, the exhaust valves 25 and 54 are both opened when it is desired to collapse the umbrella.

The umbrella 40 may be formed by a second embodiment of the method of the present invention as illustrated in FIG. 8. In particular, the undercarriage 15 is formed by first providing a second sheet 16 of flexible plastic material having a generally star-like peripheral outline, with the second sheet being provided with a central opening 21. The handle is composed of a tubular member 20, a tubular bulbous portion 22 joined to the free end of the tubular component and having the two valves 24, 25 positioned therein, and a flexible plastic bag 32 which may be joined to the free end of the bulbous portion in the manner indicated in FIG. 8.

The valve 52 is mounted to cover the opening 21 in the sheet 16, and the tubular member 20 is thereafter joined to the second sheet 16, by heat sealing or the like, and such that the tubular member communicates via the valve 52 with the opening 21 therein. The valve 54 is mounted centrally in the first sheet 12, and the second sheet 16 is then positioned centrally over the under surface of the first sheet 12, and the second sheet is joined along its periphery to the first sheet to form an enclosed airspace 18 therebetween which communicates through the opening 21 with the interior of the tubular member.

In the drawings and specification, there have been set forth preferred embodiments of the invention and although specific terms are employed, they are used in a generic and descriptive sense only and not for purposes of limitation.

That which is claimed is:

1. An inflatable umbrella characterized by the ability to be collapsed and retained in the form of a small easily carried package when not in use, and to be rapidly inflated to an operative configuration by the breath of the user or the like, and comprising a flexible plastic cover sheet having a generally circular outline, a flexible plastic panel overlying one surface of said cover sheet and being sealably joined along its peripheral edge to said one surface to define an enclosed airspace therebetween, an elongate flexible plastic tubular member having one end sealably joined to said panel and so that the interior of said tubular member is in fluid communication with said enclosed airspace, valve means mounted for permitting air to be selectively blown into and released from the interior of said tubular member and said enclosed airspace, and flexible bag means mounted at the other end of said tubular member, with said bag means being sized to receive and retain the cover sheet, panel and tubular member when collapsed, whereby the umbrella may be inflated to an operative configuration by blowing air through said valve means and into said tubular member and enclosed airspace, and such that the resulting air pressure serves to rigidify the tubular member and support the cover sheet and panel in a generally open expanded configuration, and the umbrella may be collapsed by releasing the air through said valve means to permit the cover sheet, panel, and tubular member to be folded into said bag means.

2. The inflatable umbrella as defined in claim 1 wherein said bag means comprises a flexible plastic sheet material, and the bottom portion of said bag means is joined to said other end of said tubular member, and such that said bag means extends axially over a portion of said other end of said tubular member and may be everted to open in a direction facing opposite said tubular member.

3. The inflatable umbrella as defined in claim 2 wherein said valve means comprises a one way inlet valve adapted to only permit air to enter said tubular member, and a second manually closable exhaust valve adapted to permit passage of air in either direction.

4. The inflatable umbrella as defined in claim 3 wherein said tubular member includes an enlarged bulbous portion immediately adjacent said other end, with said bulbous portion being sized to permit ready engagement by the hand of the user.

5. The inflatable umbrella as defined in claim 4 wherein each of said inlet and exhaust valves is mounted on said bulbous portion of said tubular member.

6. The inflatable umbrella as defined in any one of claims 1–5 wherein said valve means further comprises a one way valve mounted interiorly of said tubular member and adjacent said one end thereof, to permit air to be forced into said enclosed airspace by manually squeezing said tubular member.

7. The inflatable umbrella as defined in any one of claims 1–5 wherein said panel has a generally star-like peripheral outline.

8. The inflatable umbrella as defined in any one of claims 1–5 wherein said umbrella further includes a drawstring operatively disposed about the circular periphery of said cover sheet, to permit the cover sheet to be drawn into a somewhat hemispheric configuration and the circumference thereof to be selectively varied.

9. An inflatable umbrella characterized by the ability to be collapsed and retained in the form of a small easily carried package when not in use, and to be rapidly and easily inflated to an operative configuration by the breath of the user or the like, and comprising a flexible plastic cover sheet having a generally circular outline, a flexible plastic panel overlying one surface of said cover sheet and being sealably joined along its peripheral edge to said one surface to define an enclosed airspace therebetween, said panel having an opening at the midpoint thereof, an elongate flexible plastic tubular member having one end sealably joined to said panel at said opening, valve means mounted for permitting air to be selectively blown into and released from the interior of said tubular member and said enclosed airspace, and including an inlet valve mounted on said tubular member, and one way interior valve means mounted to close said opening in said panel and for permitting air to move from said tubular member into said enclosed airspace while precluding movement in the opposite direction, whereby the umbrella may be inflated to an operative configuration by blowing air through said inlet valve and into said tubular member and through said one way interior valve means to said enclosed airspace, with the one way interior valve means serving to minimize the resistance to air entering through said inlet valve, and such that the resulting air pressure serves to rigidify the tubular member and support the cover sheet and panel in a generally open expanded configuration, and the umbrella may be collapsed by releasing the air through said valve means to permit the cover sheet, panel, and tubular member to be folded into an easily carried package.

10. The inflatable umbrella as defined in claim 9 wherein said valve means further comprises a first exhaust valve mounted on said cover sheet so as to directly communicate with said enclosed airspace, and a second exhaust valve mounted on said tubular member so as to directly communicate with the interior thereof.

11. An inflatable plastic umbrella characterized by the ability to be collapsed into the form of a small package when not in use, and to be rapidly inflated to an operative configuration by the breath of the user or the like, and comprising a flexible plastic cover sheet having a generally circular periphery, and a drawstring operatively disposed about said circular periphery, a flexible plastic panel of generally star-like outline, said panel member overlying one surface of said cover sheet and being sealably joined along its peripheral edge to said one surface to define an enclosed airspace therebetween, an elongate flexible plastic tubular member having one end sealably joined to the midpoint of said panel and so that the interior of said tubular member is in fluid communication with said enclosed airspace, and valve means communicating with said tubular member for permitting air to be selectively blown into and released from the interior of said tubular member and thus said enclosed airspace, said valve means including an inflation valve adapted to permit air to only enter said tubular member, and a separate deflation valve adapted to permit rapid passage of air in either direction, whereby the umbrella may be inflated to an operative configuration by blowing air through said inflation valve and into said tubular member and enclosed airspace, and such that the resulting air pressure serves to rigidify the tubular member and support said cover sheet and panel in a generally open expanded configuration, and the umbrella may be rapidly collapsed by releasing the air through said deflation valve to permit the cover sheet, panel member, and tubular member to be collapsed into a conveniently sized small package.

* * * * *